US012408752B2

(12) United States Patent
Farjamrad

(10) Patent No.: US 12,408,752 B2
(45) **Date of Patent: *Sep. 9, 2025**

(54) CABINET HANGING SYSTEM

(71) Applicant: PRIME TECH CABINETS, INC., Santa Ana, CA (US)

(72) Inventor: Bobby Farjamrad, Santa Ana, CA (US)

(73) Assignee: PRIME TECH CABINETS, INC., Santa Ana, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/346,088

(22) Filed: Jun. 11, 2021

(65) Prior Publication Data

US 2021/0298475 A1 Sep. 30, 2021

Related U.S. Application Data

(63) Continuation of application No. 16/445,591, filed on Jun. 19, 2019, now Pat. No. 11,058,222, which is a continuation of application No. 16/027,079, filed on Jul. 3, 2018, now Pat. No. 10,342,345.

(51) Int. Cl.
*A47B 95/00* (2006.01)
*A47B 96/06* (2006.01)

(52) U.S. Cl.
CPC ..... *A47B 95/008* (2013.01); *A47B 96/067* (2013.01)

(58) Field of Classification Search
CPC ..... A47B 95/008; A47B 96/067; A47B 96/06; A47B 47/0041; A47B 95/002; A47B 47/042; A47B 97/001; A47B 2220/0052; A47B 47/0075; A47B 47/0091; A47B 85/00; A47B 96/1441; A47B 83/045; A47B 77/00; A47B 96/14; A47B 2230/06;

(Continued)

(56) References Cited

U.S. PATENT DOCUMENTS

| | | | |
|---|---|---|---|
| 2,521,134 | A | 9/1950 | Stanitz |
| 2,708,147 | A | 5/1955 | Duggan |
| 3,241,850 | A | 3/1966 | Porpst |

(Continued)

FOREIGN PATENT DOCUMENTS

| | | |
|---|---|---|
| DE | 4114378 | 11/1992 |
| FR | 2404411 | 4/1979 |
| GB | 2444897 A | 6/2008 |

*Primary Examiner* — Hiwot E Tefera

(74) *Attorney, Agent, or Firm* — Jafari Law Group, Inc.

(57) ABSTRACT

The invention is generally a cabinet hanging system that, in exemplary embodiments, includes a wall cleat hanger and at least one cabinet. The at least one cabinet has a plurality of recesses on its rear exterior edge that are substantially similar to the same shape of the wall cleat hanger. The recesses allow a user to hang the cabinets on their wall without needing to fasten the cabinets to the wall cleat hanger or the wall. This invention alleviates the burden of complicated cabinet systems installations while simultaneously allowing the user to install the cabinet system without the assistance of another person. In an exemplary embodiment, the cabinet has a first elongated recess and a second elongated recess. Terminal cabinets replace one elongated recess with a finished panel and a wall cleat. The wall cleat allows terminal cabinets to securely rest on the wall cleat hanger.

12 Claims, 14 Drawing Sheets

(58) Field of Classification Search
CPC ..... A47F 5/08; A47F 5/0838; A47F 5/0846; A47F 5/00
USPC ..... 312/245, 198, 257.1, 246, 263, 265.5; 211/94.01, 90.01, 90.04, 90.02, 87.01, 211/105.1, 189, 175, 85.3, 118, 186, 187, 211/86.01; 108/152; 248/225.51, 225.2, 248/225.21, 222.11, 225.11, 214, 215, 248/216.1, 227.4, 250, 501, 500, 223.41, 248/339, 224.61
See application file for complete search history.

(56) References Cited

U.S. PATENT DOCUMENTS 3,669,035 A 6/1972 Grossman
3,698,565 A 10/1972 Weber
3,885,845 A 5/1975 Krieks
3,899,228 A * 8/1975 Schreiber ..... A47B 47/042 312/107
3,908,831 A 9/1975 Brendgord
3,950,049 A 4/1976 Drass
4,165,852 A 8/1979 Chervenak
4,228,906 A 10/1980 Jones
4,329,003 A 5/1982 Manchester
4,342,439 A 8/1982 Bruner
4,629,076 A 12/1986 Amstutz
4,928,833 A * 5/1990 Huizenga ..... A47B 95/008 211/187
5,050,832 A * 9/1991 Lee ..... A47B 95/008 248/222.51
5,222,611 A 6/1993 Wood
5,392,934 A * 2/1995 Fox ..... A47F 5/0846 248/220.31
5,412,912 A 5/1995 Alves
5,582,306 A * 12/1996 Balter ..... A47B 61/00 211/187
5,624,168 A 4/1997 Licciardello
5,819,958 A 10/1998 Dement
5,951,127 A * 9/1999 Smith ..... A47B 87/007 248/909
6,113,201 A 9/2000 Bauer
8,444,235 B2 5/2013 Gmerek
9,526,336 B2 12/2016 Wells
2006/0091271 A1 5/2006 Nowak
2006/0283822 A1 12/2006 Jacques
2008/0173778 A1 7/2008 Mertens
2010/0308702 A1 12/2010 Apgood
2011/0025180 A1 2/2011 Ilich
2011/0147551 A1 6/2011 Richard
2013/0134849 A1* 5/2013 Menzel ..... A47B 95/008 312/265.5
2015/0053635 A1* 2/2015 Ahart ..... A47B 96/06 211/206
2015/0351538 A1 12/2015 Wells
2016/0045026 A1 2/2016 Trunkle
2016/0235195 A1* 8/2016 Ahart ..... A47B 96/024
2017/0079426 A1 3/2017 Davis
2018/0098629 A1 4/2018 Knepper

* cited by examiner

203

CABINET HANGING SYSTEM

TECHNICAL FIELD OF THE INVENTION

The present invention relates generally to storage systems, and more specifically, to a wall-mounted storage system capable of being installed by an individual.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Storage systems capable of being mounted to walls, such as the walls in a kitchen, garage, or office, are well known in the art. However, the wall-mounted storage systems described in the prior art are cumbersome and difficult to install, especially when said storage systems are being installed by an individual. The challenge in solo-installing wall-mounted storage systems is particularly present when various tools and fasteners are required because at least one person is needed to hold the storage system level and at the desired height while at least one additional person is needed to fasten and secure the cabinet to the wall.

Additionally, once the storage system is mounted to the wall, it is often equally as cumbersome to uninstall and reinstall the cabinets. For example, changes to a person's walls or personal preferences may leave said person inclined to change which direction the doors on the cabinets open. In order to facilitate this change, the doors would have to be removed from their hinges or other fasteners, flipped, and reattached to said hinges or fasteners. As is all too common, getting the doors to perfectly realign is no easy feat. Also, removing and reattaching the doors may require the efforts of multiple people because one person may need to hold the door steady while another person detaches and reattaches the door.

There have been attempts to solve this and other related wall-mounted storage system problems. For example, U.S. Pat. No. 9,526,336 to Wells (the "'336 Patent") describes a storage system wherein the cabinets have notches on the upper back portion of the cabinet which are used to slide the cabinet over the alignment rail. However, the storage members of the '336 Patent are attached to the wall via at least one fastener that extends through a first rail and a second rail. The use of fasteners to attach the cabinets to the wall is not only less cost effective but also decreases the ease with which a solo installer may install the storage system because more tools and people are required to complete installation. Furthermore, the '336 Patent only has notches on the upper back portion of the cabinets, and thus the cabinets are only capable of being installed in a single orientation; such a design limits how doors on the cabinet may open The prior art illuminates a clear deficiency in existing wall-mounted storage systems. Therefore, there exists a previously unappreciated need for a new and improved wall-mounted storage system that can easily be installed by an individual without needing to use fasteners to attach the cabinets to a wall cleat hanger. The present invention overcomes the above-described disadvantages of presently existing wall-mounted storage systems. It is to these ends that the present invention has been developed.

SUMMARY OF THE INVENTION

To minimize the limitations in the prior art, and to minimize other limitations that will be apparent upon reading and understanding the present specification, the present invention describes a wall-mounted storage system, such as cabinets for use in a kitchen, garage, or office, which can be easily and quickly installed by an individual. A wall-mounted storage system in accordance with the present invention may incorporate a plurality of cabinets with a plurality of hanger cutouts, or recesses, located on a rear exterior edge of said cabinets, the hanger cutouts being designed to receive a wall cleat hanger that is fastened to a wall.

An apparatus in accordance with one embodiment of the present invention may be comprised of a wall cleat hanger and a plurality of cabinets, each cabinet further comprising at least two pairs of recesses located on upper and lower portions of a rear exterior edge of said cabinets, the recesses being formed to receive and rest on the wall cleat hanger. The recesses may have an upper and lower boundary to securely receive and rest on the wall cleat hanger, thereby mounting the cabinets to a wall and preventing said cabinets from falling off the wall.

Another apparatus in accordance with one embodiment of the present invention may be comprised of a wall cleat hanger and a plurality of cabinets, each cabinet further comprising an at least single pair of recesses located on a rear exterior edge of said cabinets, the recesses being formed to receive and rest on the wall cleat hanger. The at least single pair of recesses may be elongated and allow a user to mount the cabinets to a wall, thereby preventing said cabinets from falling off the wall. Furthermore, having an elongated recess may allow a user to install the cabinets on bumpy, uneven, and/or warped walls. This is because the elongated recesses would be able to accommodate the wall's protrusions without forcing the cabinet to extend away from the wall.

A method of installing a plurality of cabinets on a wall cleat hanger in accordance with one embodiment of the present invention may comprise the steps of fastening the wall cleat hanger to a wall and attaching the cabinet to said wall cleat hanger by lining up a plurality of recesses on a rear exterior edge of said cabinet and sliding said cabinet along the wall cleat hanger until the cabinet reaches a desired position.

A method of installing a plurality of cabinets on a wall cleat hanger in accordance with another embodiment of the present invention may comprise the steps of fastening the wall cleat hanger to a wall and attaching the cabinet with an at least one pair of recesses to said wall cleat hanger by placing an upper surface of the at least one pair of recesses superior to the wall cleat hanger and lowering the cabinet onto the wall cleat hanger until the upper surface of the at least one pair of recesses is resting on the wall cleat hanger.

These and other advantages and features of the present invention are described herein with specificity in order to make the present invention understandable to one of ordinary skill in the art.

BRIEF DESCRIPTION OF THE DRAWINGS

Elements in the figures have not necessarily been drawn to scale in order to enhance their clarity and improve understanding of the various embodiments of the invention. Furthermore, elements that are known to be common and well understood to those in the industry are not depicted in order to provide a clear view of the various embodiments of the invention.

FIG. 4(*b*) is a cross-sectional view of the mounting rail in accordance with the present invention.

FIG. 8(*b*) is a cross-sectional view of the wall cleat hanger in accordance with the present invention.

FIG. 9(*b*) is a rear perspective view of a terminal right cabinet installed on a wall in accordance with the present invention.

DETAILED DESCRIPTION OF THE INVENTION

Figure 1:
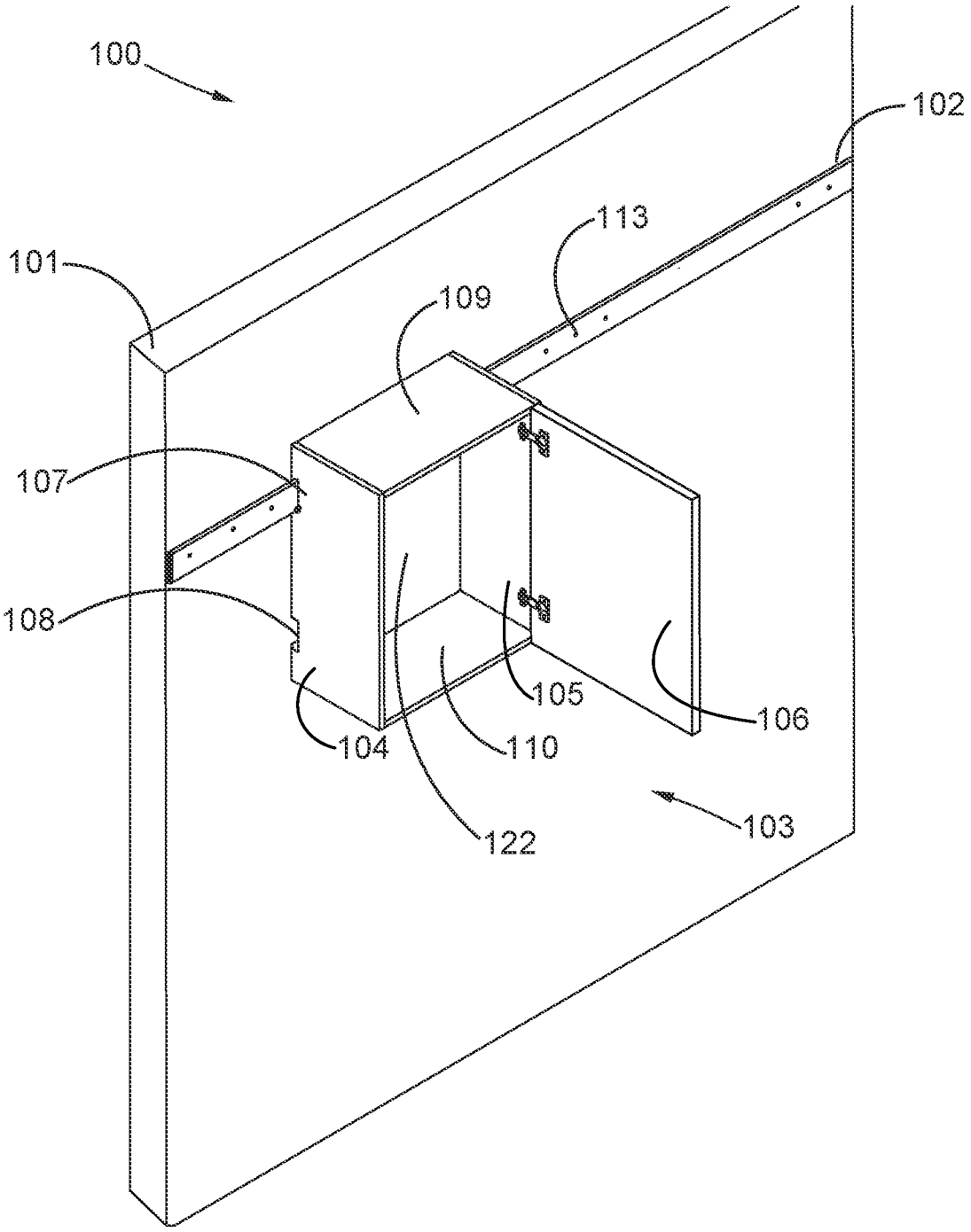
FIG. 1 is a perspective view of one embodiment of a cabinet hanging system in accordance with the present invention.

In the following discussion that addresses a number of embodiments and applications of the present invention, reference is made to the accompanying drawings, which form a part thereof. Depictions are made, by way of illustration, of specific embodiments in which the invention may be practiced; however, it is to be understood that other embodiments may be utilized, and changes may be made without departing from the scope of the present invention. Wherever possible, the same reference numbers are used in the drawings and the following description to refer to the same or similar elements.

In the following detailed description, numerous specific details are set forth by way of examples in order to provide a thorough understanding of the relevant teachings. However, it should be apparent to those skilled in the art that the present teachings may be practiced without such details. In other instances, well-known structures, components, and/or functional or structural relationship thereof, etc., have been described at a relatively high level, without detail, in order to avoid unnecessarily obscuring aspects of the present teachings.

Throughout the specification and claims, terms may have nuanced meanings suggested or implied in context beyond an explicitly stated meaning. Likewise, the phrase "in one embodiment/example," as used herein, does not necessarily refer to the same embodiment, and the phrase "in another embodiment/example," as used herein, does not necessarily refer to a different embodiment. It is intended, for example, that the claimed subject matter include combinations of example embodiments in whole or in part.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments, whether these features, elements, and/or steps are included or are to be performed in any particular embodiment.

The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc., may be either X, Y, or Z. Thus, such conjunctive language is not generally intended to imply that certain embodiments require at least one of X, at least one of Y, and at least one of Z to each be present.

The term "and/or" means that "and" applies to some embodiments and "or" applies to some embodiments. Thus, A, B, and/or C can be replaced with A, B, and C written in one sentence and A, B, or C written in another sentence. A, B, and/or C means that some embodiments can include A and B, some embodiments can include A and C, some embodiments can include B and C, some embodiments can include only A, some embodiments can include only B, some embodiments can include only C, and some embodiments can include A, B, and C. The term "and/or" is used to avoid unnecessary redundancy. Similarly, terms such as "a," "an," or "the," again, may be understood to convey a singular usage or to convey a plural usage, depending at least in part upon context. In addition, the term "based on" may be understood as not necessarily intended to convey an exclusive set of facts and may, instead, allow of the existence of additional factors not necessarily expressly described, again, depending at least in part on context.

While exemplary embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the invention or inventions disclosed herein. Accordingly, the following detailed description does not limit the disclosure. Instead, the proper scope of the disclosure is defined by the appended claims.

Generally, the invention is a cabinet hanging system that, in exemplary embodiments, may include a wall cleat hanger, or mounting rail, and at least one cabinet. The cabinet may have a plurality of recesses on its rear exterior edge that may be substantially the same shape as the mounting rail. The recesses may allow a user to hang the cabinets on a wall without needing to fasten the cabinets to the mounting rail. This may be accomplished because the recesses on the cabinet may catch and rest on the mounting rail. This invention alleviates the burden of complicated cabinet system installations while simultaneously allowing the user to install the cabinet system without the assistance of another person.

Turning now to the figures, FIG. 1 is a perspective view of a cabinet hanging system in accordance with one embodiment of the present invention, wherein the system includes a mounting rail and a cabinet with recesses designed to receive and rest on the mounting rail. Specifically, FIG. 1 illustrates cabinet hanging system 100, which includes mounting rail 102 and cabinet 103. Mounting rail 102 may be comprised of plurality of holes 113 for receiving fasteners. Cabinet 103 may include right panel 104, left panel 105, door 106, first upper recess 107, first lower recess 108, upper panel 109, lower panel 110, and rear panel 122. First upper recess 107 and first lower recess 108 may be on a rear exterior edge of right panel 104. Not shown in FIG. 1 is the left side of cabinet 103, which may include second upper recess 111 and second lower recess 112 on a rear exterior edge of left panel 105. Second upper recess 111 and second lower recess 112 may be substantially similar to first upper recess 107 and first lower recess 108, respectively.

Mounting rail 102 may be attached to wall 101. It is envisioned that wall 101 is in a kitchen, but any wall suitable for cabinets is contemplated by the present invention, such as the walls in a garage or office. Mounting rail 102 may be affixed to wall 101 using any fastening method known in the art. By way of example and not limitation, mounting rail 102 may be affixed to wall 101 by hammering nails through plurality of holes 113 on mounting rail 102. Alternatively, other fasteners, such as screws, bolts, and/or adhesives, may be used without deviating from the scope or spirit of the present invention. A level (not shown) may be implemented to ensure mounting rail 102 is level; this may help maintain cabinet 103 in place and keep the contents of cabinet 103 from falling.

In one embodiment, plurality of holes 113 may be spaced along mounting rail 102 such that each individual hole corresponds to a stud located within wall 101 on which the user wants to install cabinet hanging system 100.

In some embodiments of the present invention, mounting rail 102 may be extendable in order to reach across at least a portion of wall 101. It may be desired to have mounting rail 102 be a length longer than the width of one cabinet 103 in order to allow multiple cabinets 103 to be attached to wall 101. For example, and without limiting the scope of the present invention, mounting rail 102 may be a quarter-inch shorter than the sum of the widths of upper panel 109 of at least one cabinet 103. It is envisioned that more than one cabinet 103 may be installed on mounting rail 102. Having more than one cabinet 103 may allow a user to store more items and may be more aesthetically pleasing to the user. It is also contemplated by the present invention that mounting rail 102 may be a predetermined length based on the user's or a manufacturer's specifications.

The material from which mounting rail 102 may be constructed is not to be limited. For example, and without limitation, mounting rail 102 may be comprised of any metal, such as aluminum, suitable for supporting cabinet 103 and its contents. Alternative materials, such as wood and/or plastic, may also be used.

After installing mounting rail 102 to a desired height on wall 101, the user may attach cabinet 103 to mounting rail 102 by positioning first upper recess 107 and second upper recess 111 (See FIG. 2) in such a way so that first upper recess 107 and second upper recess 111 align with a terminal end of mounting rail 102. As is explained in more detail below, first upper recess 107, first lower recess 108, second upper recess 111, and second lower recess 112 may each be of such a width that each recess can receive, be flush with, and rest on mounting rail 102. Once first upper recess 107 and second upper recess 111 are lined up with mounting rail 102, the user can slide cabinet 103 along mounting rail 102 until cabinet 103 reaches a desired position. As is apparent, no fasteners are required to attach cabinet 103 to mounting rail 102. Rather, the recesses support cabinet 103 and keep it attached to mounting rail 102.

In some embodiments, a user may attach cabinet 103 to mounting rail 102 by positioning first upper recess upper surface 114 and the upper surface of second upper recess 111 (See FIGS. 2 and 3) superior to mounting rail 102 and lowering cabinet 103 until first upper recess upper surface 114 and the upper surface of second upper recess 111 catch mounting rail 102. This may allow cabinet 103 to securely rest on mounting rail 102.

Right panel 104, left panel 105, upper panel 109, lower panel 110, and rear panel 122 of cabinet 103 may be formed in such a shape so as to define a cavity therein. It is envisioned that cabinet 103 is rectangularly shaped, though other shapes, including but not limited to square, circle, and oval, are contemplated by the present invention. Said cavity may be used to store any number of items.

Right panel 104, left panel 105, upper panel 109, lower panel 110, rear panel 122, and door 106 of cabinet 103 may be constructed out of any material suitable for making cabinets. By way of example and not limitation, cabinet 103 may be constructed out of wood, metal, and/or plastic. This list of materials is non-exhaustive and other materials known in the art are contemplated by the present invention.

Cabinet 103 may also be comprised of door 106. Door 106 may be useful in preventing the contents of cabinet 103 from falling out of the cavity defined by cabinet 103. In one embodiment of the present invention, door 106 may be fastened to an interior surface of left panel 105 using any fastener suitable for fastening doors to cabinets, such as but not limited to, hinges or magnetic catches. Door 106, however, may be fastened to the interior surface of any of the panels of cabinet 103. In other embodiments of the present invention, cabinet 103 may be a framed cabinet. In such embodiments, door 106 may attach to the frame of cabinet 103.

There may be situations that call for door 106, after it is attached to cabinet 103, to be oriented differently so as to allow door 106 to open in a different direction. Rather than having to detach and reattach door 106, which can be tedious, difficult, and time consuming, a user need merely slide cabinet 103 off mounting rail 102, rotate cabinet 103 180 degrees along its X-axis, and replace cabinet 103 onto mounting rail 102. Doing so flips cabinet 103 such that door 106 may now open in an orientation opposite from the orientation door 106 opened before the 180-degree rotation (i.e., door 106 opens towards the user's left-hand side instead of their right-hand side, or vice versa depending on door 106's pre-rotation orientation). This means first lower recess 108 and second lower recess 112 may be used to receive mounting rail 102.

In some embodiments of the present invention, a rightmost (from the wall's perspective) and a leftmost cabinet (from the wall's perspective) attached to mounting rail 102 may each have a removable panel that covers the upper and lower recesses that would otherwise be exposed and observable to passersby. For example, and without limitation, if cabinet 103 is a rightmost cabinet, in such embodiments cabinet 103 may have a removable and separate panel that can be placed over right panel 104. Hiding the recesses with removable panels on the terminal cabinets 103 may be preferred in order to enhance the aesthetics of cabinet hanging system 100 while still allowing cabinet 103 to be rotated should the user decide they want or need door 106 to open in the opposite direction.

The removable panel may be attachable to right panel 104 or left panel 105 by any means known in the art for removably attaching one panel to another panel. By way of example and not limitation, the removable panel may attach to right panel 104 and left panel 105 by using magnets placed on an interior surface of the removable panel and an exterior or interior surface of right panel 104 and left panel 105. Alternatively, other methods of attaching the removable panel to cabinet 103 may be implemented and are contemplated by the present invention, such as a peg located on either the removable panel or right panel 104 and left panel 105 and a corresponding peg-receiving hole located at substantially the same position on the panel that does not have the peg.

Figure 2:
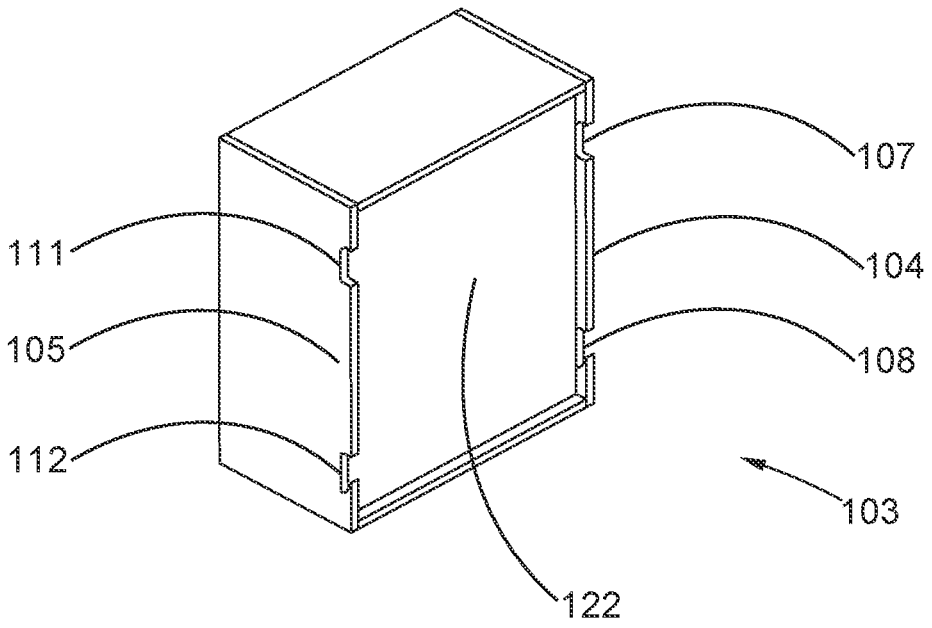
FIG. 2 is a rear perspective view of a cabinet used in the cabinet hanging system in accordance with the present invention.

FIG. 2 is a rear perspective view of a cabinet used in cabinet hanging system 100 in accordance with the present invention. As may be better illustrated by this figure, cabinet 103 may have a plurality of recesses suitable for receiving mounting rail 102 (not shown). In some embodiments, cabinet 103 may be comprised of first upper recess 107, first lower recess 108, second upper recess 111, and second lower recess 112. A greater or fewer number of recesses may be implemented without deviating from the spirit or scope of the present invention.

As can be seen by FIG. 2, first upper recess 107 may align with second upper recess 111 along a first horizontal axis, and first lower recess 108 may align with second lower recess 112 along a second horizontal axis. Having upper recesses 107 and 111 located on the first horizontal axis and lower recesses 108 and 112 located on the second horizontal axis may facilitate installation of cabinet 103 onto mounting rail 102 because cabinet 103 will more easily slide and rest on mounting rail 102, which is envisioned to be straight in preferred embodiments.

First upper recess 107 and first lower recess 108 may be cutout from a rear exterior edge of right panel 104. Similarly, second upper recess 111 and second lower recess 112 may be cutout from a rear exterior edge of left panel 105. Having the recesses 107, 108, 111, and 112 be a part of cabinet 103, as opposed to separate pieces attached to cabinet 103, makes cabinet hanging system 100 less expensive, lighter, stronger, and easier for a user to install by him- or herself.

Rear panel 122 may be offset into the cavity of cabinet 103 by a distance sufficient to allow first upper recess 107, first lower recess 108, second upper recess 111, and second lower recess 112 to receive and rest on mounting rail 102. For example, and not limitation, if first upper recess 107, first lower recess 108, second upper recess 111, and second lower recess 112 are each seven-eighths of an inch deep, rear panel 122 may be offset into the cavity of cabinet 103 by one inch. It is contemplated that rear panel 122 may be offset into the cavity of cabinet 103 by other distances without deviating from the present invention.

Figure 3:
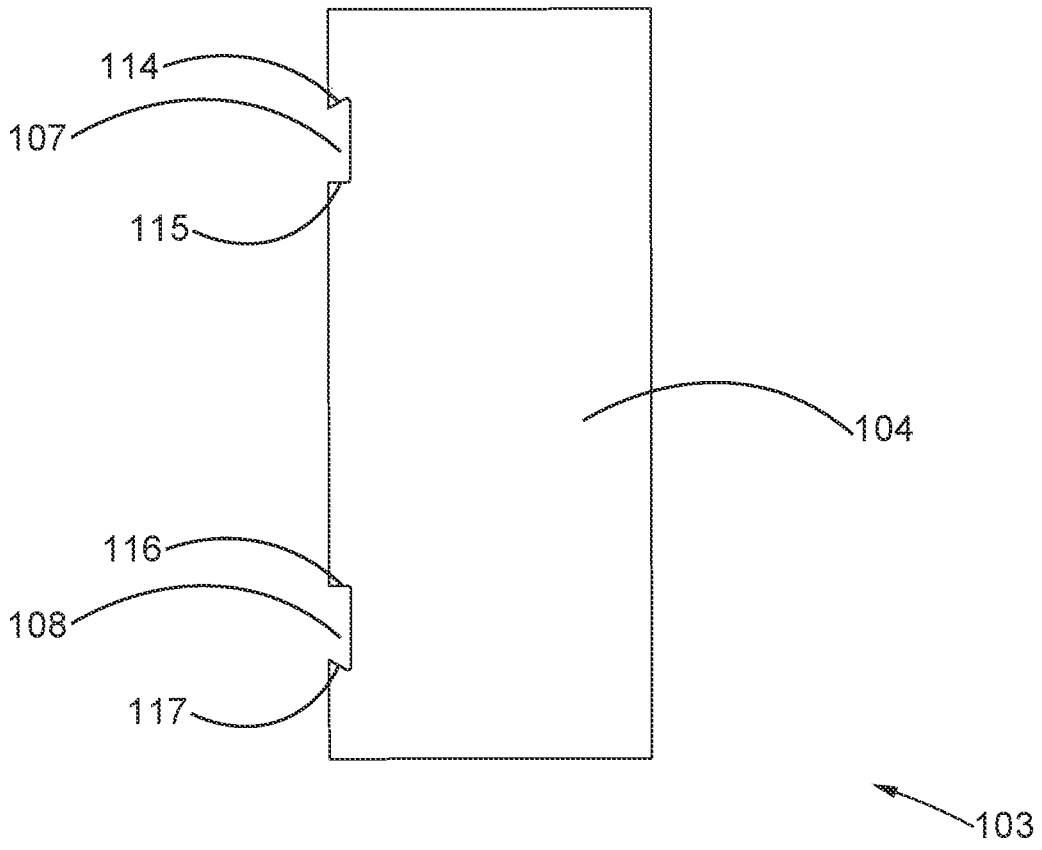
FIG. 3 is a side view of a cabinet used in the cabinet hanging system in accordance with the present invention, showing the right side of the cabinet.

Turning now to the next figure, FIG. 3 depicts a side view of the right side of cabinet 103 in accordance with the present invention. As can been seen, first upper recess 107 may be further comprised of first upper recess upper surface 114 and first upper recess lower surface 115. Likewise, first lower recess 108 may be further comprised of first lower recess upper surface 116 and first lower recess lower surface 117. Though not shown, second upper recess 111 and second lower recess 112 may be designed similarly to first upper recess 107 and first lower recess 108, respectively.

Figure 4A:
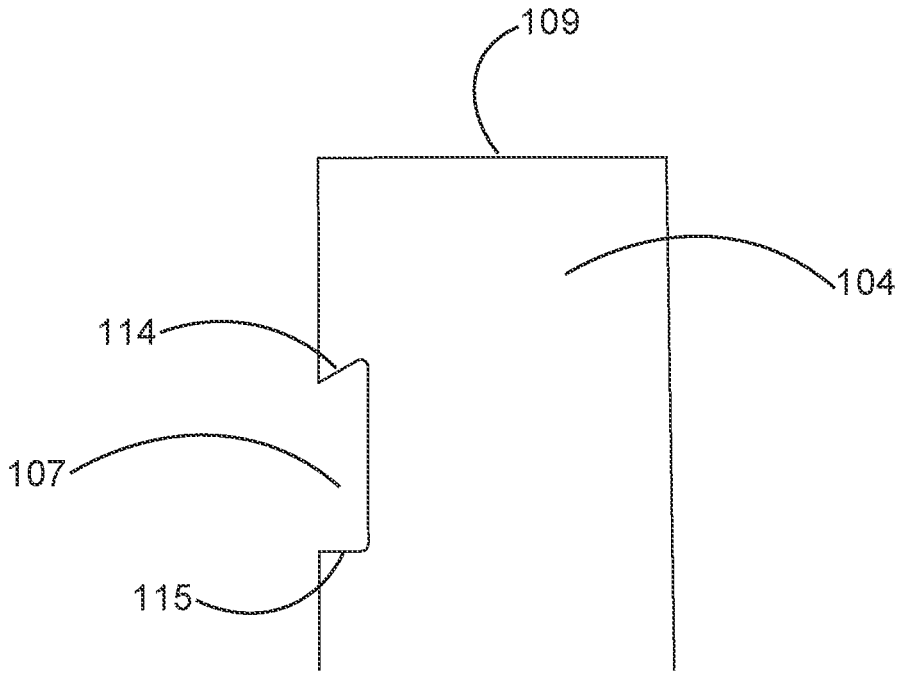
FIG. 4(*a*) is an enhanced view of an upper recess on the right side of a cabinet used in the cabinet hanging system, showing more detail of a first upper recess.
Figure 4B:
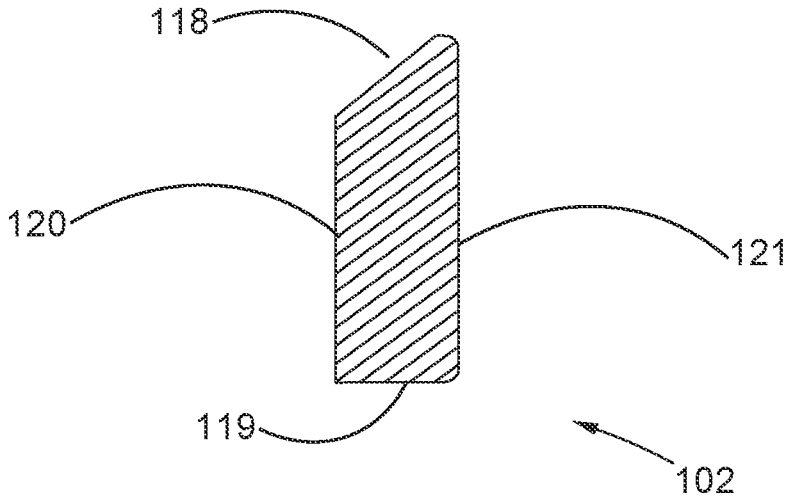

In some embodiments, first upper recess upper surface 114 may be angled diagonally up and toward the cavity defined by cabinet 103, and first upper recess lower surface 115 may extend perpendicularly toward the cavity defined by cabinet 103. Thus, first upper recess 107 may be convex, and the opening defined by first upper recess 107 may extend along an inward side of right panel 104. First upper recess 107 may be designed this way so as to more easily receive and retain mounting rail 102 (not shown). As shown in FIG. 4(*b*), the shape of mounting rail 102 may substantially match the shape of first upper recess 107. Alternatively, first upper recess 107 may be differently shaped to retain mounting rail 102 without departing from the scope and spirit of the present invention. First upper recess upper surface 114 may be angled in this manner in order to allow first upper recess 107 to securely catch and rest on mounting rail 102.

First lower recess 108 may mirror first upper recess 107 along a horizontal axis of cabinet 103. First lower recess 108 may be a mirrored reflection of first upper recess 107 because, as described above, a user may desire to rotate cabinet 103 180 degrees along its X-axis so that door 106 (not shown) opens in the opposite direction. To facilitate such rotations, first lower recess upper surface 116 may extend perpendicularly toward the cavity, and first lower recess lower surface 117 may be angled diagonally down and toward the cavity defined by cabinet 103. Thus, when a user rotates cabinet 103 180 degrees along its X-axis, naturally leading to first lower recess being superior to first upper recess, cabinet 103 can securely rest on mounting rail 102.

Though not shown, second upper recess 111 may be substantially similar to first upper recess 107. Furthermore, second lower recess 112 may be substantially similar to first lower recess 108.

FIG. 4(*a*) is an enhanced view of first upper recess 107 in accordance with the present invention. First upper recess upper surface 114 may be located substantially near upper panel 109. In a preferred embodiment, it is envisioned that, for example and not limitation, first upper recess upper surface 114 may be located four inches inferior to upper panel 109, the recess formed by first upper recess upper surface 114 and first upper recess lower surface 115 may be three inches, and the angled portion of first upper recess upper surface 114 may extend into right panel 104 seven-eighths of an inch. These measurements may be slightly larger than the measurements of mounting rail 102 (See FIG.

4(*b*)), thus allowing mounting rail 102 to snugly fit within first upper recess 107. The measurements of first upper recess 107 may be augmented or decreased without deviating from the scope or spirit of the present invention.

Though not shown, it is envisioned that first lower recess lower surface 117 may be located substantially near lower panel 110. In a preferred embodiment, first lower recess lower surface 117 may be located, for example and not limitation, four inches superior to lower panel 110, and the angled portion of first lower recess lower surface 117 may extend into right panel 104 seven-eighths of an inch. These measurements may be slightly larger than the measurements of mounting rail 102 (See FIG. 4(*b*)), thus allowing mounting rail 102 to snugly fit within first lower recess lower surface 117. The measurements of first lower recess lower surface 117 may be augmented or decreased without deviating from the scope or spirit of the present invention.

Though not shown, second upper recess 111 and second lower recess 112 may have measurements substantially similar to the measurements of first upper recess 107 and first lower recess 108, respectively.

Turning to the next figure, FIG. 4(*b*) illustrates a cross-sectional view of mounting rail 102 in accordance with the present invention. Mounting rail 102 may be comprised of mounting rail upper surface 118, mounting rail lower surface 119, mounting rail wall surface 120, and mounting rail cabinet surface 121. In preferred embodiments, mounting rail upper surface 118 may abut first upper recess upper surface 114 of first upper recess 107 (and the upper surface of second upper recess 111), mounting rail lower surface 119 may abut first upper recess lower surface 115 of first upper surface 107 (and the lower surface of second upper recess 111), mounting rail wall surface 120 may abut wall 101, and mounting rail cabinet surface 121 may abut the rear exterior surfaces of right panel 104 and left panel 105.

The measurements of mounting rail 102 may be slightly less the measurements of first upper recess 107, first lower recess 108, second upper recess 111, and second lower recess 112. Having the measurements of mounting rail 102 be similar to the measurements of the recesses may allow cabinet 103 to lay flush against wall 101 and thus increase stability and allow cabinet 103 to snugly rest on mounting rail 102.

Figure 5:
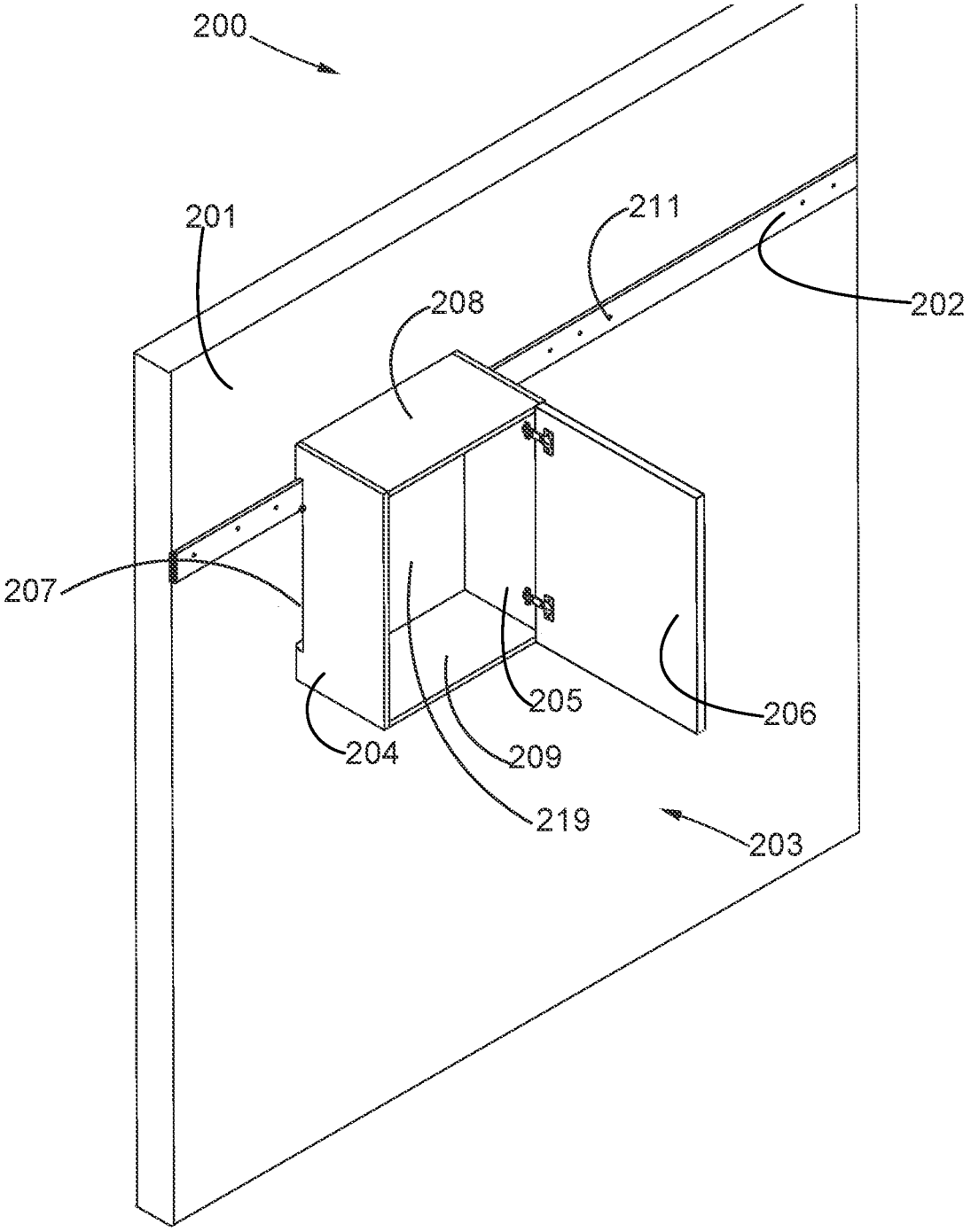
FIG. 5 is a perspective view of one embodiment of a cabinet hanging system in accordance with the present invention.

Turning to the next figure, FIG. 5 depicts a perspective view of one embodiment of a cabinet hanging system in accordance with the present invention, wherein the cabinet hanging system includes a wall cleat hanger and a cabinet with an elongated recess designed to receive the wall cleat hanger. Specifically, FIG. 5 illustrates cabinet hanging system 200, which includes wall cleat hanger 202 and cabinet 203. Wall cleat hanger 202 may be comprised of plurality of holes 211 for receiving fasteners. Cabinet 203 may include right panel 204, left panel 205, door 206, first elongated recess 207, upper panel 208, lower panel 209, and rear panel 219. First elongated recess 207 may be on the rear exterior edge of right panel 204. Cabinet 203 may also include second elongated recess 210 (not shown) on the rear exterior edge of left panel 205. Second elongated recess 210 may be substantially similar to first elongated recess 207.

Wall cleat hanger 202 may be attached to wall 201. It is envisioned that wall 201 is in a kitchen, but any wall suitable for cabinets is contemplated by the present invention, such as the walls in a garage or office. Wall cleat hanger 202 may be affixed to wall 201 using any fastening method known in the art. By way of example and not limitation, wall cleat hanger 202 may be affixed to wall 201 by hammering nails through plurality of holes 211 on wall cleat hanger 202. Alternatively, other fasteners, such as screws, bolts, and/or adhesives, may be used. A level (not shown) may be implemented to ensure wall cleat hanger 202 is level; this may help maintain cabinet 203 in place and keep the contents of cabinet 203 from falling.

In one embodiment, plurality of holes 211 may be spaced along wall cleat hanger 202 such that each individual hole may correspond to a stud located within the wall on which the user wants to install cabinet hanging system 200.

In some embodiments of the present invention, wall cleat hanger 202 may be extendable in order to reach across at least a portion of wall 201. For example, and not limitation, wall cleat hanger 202 may be a quarter-inch shorter than the sum of the width of upper panel 208 of cabinet 203. It may be desired to have wall cleat hanger 202 be extendable to allow more than one cabinet 203 to be attached to wall 201. Having more than one cabinet 203 may allow a user to store more items and may be more aesthetically pleasing. It is also contemplated by the present invention that wall cleat hanger 202 may be a predetermined length based on the user's or a manufacturer's specifications.

The material from which wall cleat hanger 202 may be constructed is not to be limited. For example, and without limitation, wall cleat hanger 202 may be comprised of any materials suitable for supporting cabinet 203 and its contents, such as wood, plastic or metal including a light metal such as aluminum. In an exemplary embodiment, wall cleat hanger 202 is a wooden cleat without pre-existing holes and may be simply screwed into studs on the wall.

After installing wall cleat hanger 202 to a desired height on wall 201, the user may attach cabinet 203 to wall cleat hanger 202 by positioning first elongated recess 207 and second elongated recess 210 (See FIG. 6) so that first elongated recess 207 and second elongated recess 210 may align with a terminal end of wall cleat hanger 202. As explained below in more detail, first elongated recess 207 and second elongated recess 210 may each be of such a width that each can receive, and be flush with, wall cleat hanger 202. Once first elongated recess 207 and second elongated recess 210 are lined up with wall cleat hanger 202, the user can easily slide cabinet 203 along wall cleat hanger 202 until cabinet 203 reaches a desired position on wall 201. As is apparent, no fasteners are required to attach cabinet 203 to wall cleat hanger 202.

In some embodiments, a user may, instead of sliding cabinet 203 along wall cleat hanger 202, attach cabinet 203 to wall cleat hanger 202 by positioning first recess upper surface 212 and the upper surface of second elongated recess 210 (See FIGS. 6 and 7) superior to wall cleat hanger 202 and lowering cabinet 203 until first recess upper surface 212 and the upper surface of second elongated recess 210 catch wall cleat hanger 202. This installation method is possible because neither first elongated recess 207 nor second elongated recess 210 have a lower boundary.

Right panel 204, left panel 205, upper panel 208, lower panel 209, and rear panel 219 of cabinet 203 may be formed in such a shape so as to define a cavity therein. It is envisioned that cabinet 203 is rectangularly shaped, though other shapes, including but not limited to square, circle, and oval, may be implemented and are contemplated by the present invention. Said cavity may be used to store any number of items.

Cabinet 203 may also be comprised of door 206. Door 206 may be useful in preventing the contents of cabinet 203 from falling out of the cavity defined by cabinet 203. In one embodiment of the present invention, door 206 may be fastened to an interior surface of left panel 205 using any fastener suitable for fastening doors to cabinets, such as but not limited to, hinges or magnetic catches. Door 206 may be fastened to the interior surface of any of the panels of cabinet 203. In other embodiments of the present invention, cabinet 203 may be a framed cabinet. In such embodiments, door 206 may attach to the frame of cabinet 203.

There may be situations that call for door 206, after it is attached to cabinet 203, to be oriented differently so as to allow door 206 to open in a different direction. Rather than having to detach and reattach door 206, which can be tedious, difficult, and time consuming, a user need merely remove cabinet 203 from wall cleat hanger 202, rotate cabinet 203 180 degrees along its X-axis, and replace cabinet 203 on wall cleat hanger 202. Doing so effectively flips cabinet 203 such that door 206 may now open in an orientation opposite from the orientation door 206 opened before the 180-degree rotation (i.e., door 206 opens towards the user's left-hand side instead of their right-hand side, or vice versa depending on door 206's pre-rotation orientation).

Right panel 204, left panel 205, upper panel 208, lower panel 209, rear panel 219, and door 206 of cabinet 203 may be constructed out of any material suitable for cabinets. By way of example and not limitation, cabinet 203 may be constructed out of wood, metal, and/or plastic. This list of materials is non-exhaustive as other materials known in the art are contemplated by the present invention.

Figure 6:
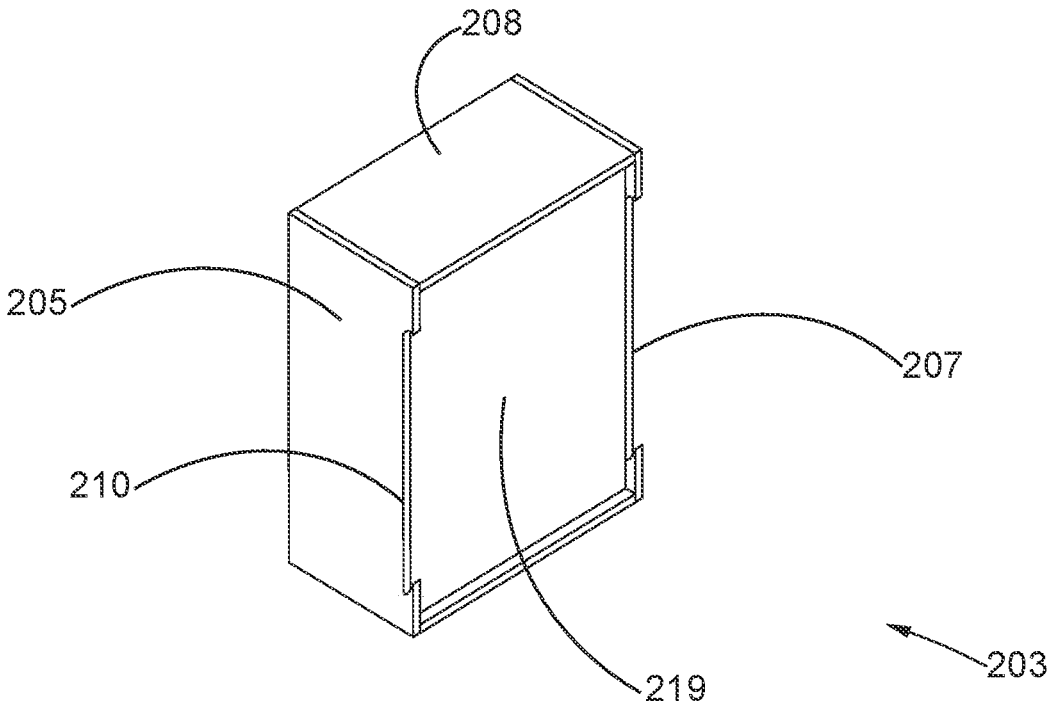
FIG. 6 is a rear perspective view of a cabinet used in the cabinet hanging system in accordance with the present invention.

FIG. 6 is a rear perspective view of cabinet 203 in accordance with the present invention. Cabinet 203 may have a first elongated recess 207 and a second elongated recess 210 suitable for receiving wall cleat hanger 202 (not shown). First elongated recess 207 may comprise an opening that vertically extends from substantially near upper panel 208 to substantially near lower panel 209 along a rear exterior edge of right panel 204, and second elongated recess 210 may also comprise an opening that vertically extends from substantially near upper panel 208 to substantially near lower panel 209 along a rear exterior edge of left panel 205. By way of example and not limitation, first elongated recess upper surface 212 and first elongated recess lower surface 213 (See FIG. 7) may be located three and one-half inches inferior to upper panel 208 and superior to lower panel 209, respectively. These measurements are only for example as first elongated recess upper surface 212 and first elongated recess lower surface 213 may be located other distances from upper panel 208 and lower panel 209, respectively, without deviating from the scope or spirit of the present invention. Having first elongated recess 207 and second elongated recess 210 be elongated may help cabinet 203 lay flush against an unlevel wall. For example, if wall 201 is warped, bumpy, or generally uneven, the non-smooth portion of wall 201 can be received by first elongated recess 207 and second elongated recess 210 such that the wall distortion does not disrupt the flushness of cabinet 203 since there are fewer points of contact between wall 201 and cabinet 203.

First elongated recess 207 may align with second elongated recess 210 along a horizontal axis of cabinet 203. Having first recess 201 and second elongated recess 210 aligned with each other on the horizontal axis may facilitate installation of cabinet 203 onto wall cleat hanger 202 because cabinet 203 will more easily slide onto wall cleat hanger 202, which is envisioned to be parallel to a floor in preferred embodiments.

Rear panel 219 may be offset into the cavity of cabinet 203 by a distance sufficient to allow first elongated recess 207 and second elongated recess 210 to receive and rest on wall cleat hanger 202. For example, and not limitation, if first elongated recess 207 and second elongated recess 210 are both seven-eighths of an inch deep, rear panel 219 may be offset into the cavity of cabinet 203 by one inch. It is contemplated by the present invention that rear panel 219 may be offset into the cavity of cabinet 203 by other distances.

First elongated recess 207 may be cutout from a rear exterior edge of right panel 204. Similarly, second elongated recess 210 may be cutout from a rear exterior edge of left panel 205. Having first elongated recess 207 and second elongated recess 210 be a part of cabinet 203, as opposed to separate pieces that are attached to cabinet 203, makes cabinet hanging system 200 less expensive, lighter, stronger, and easier for a user to install by him- or herself.

First elongated recess 207 may be in proximity to a terminal rear end of right panel 204 and second elongated recess 210 may be in proximity to a terminal rear end of left panel 205. Thus, when cabinet 203 is mounted on wall cleat hanger 202, first elongated recess 207 and second elongated recess 210 may be adjacent to wall 201. Furthermore, first elongated recess 207 and second elongated recess 210 may each vertically extend between upper panel 208 and lower panel 209. However, in other embodiments of the present invention, first elongated recess 207 and second elongated recess 210 may be located on upper panel 208 and lower panel 209, respectively; in such an embodiment, first elongated recess 207 and second elongated recess 210 may horizontally extend between right panel 204 and left panel 205.

Figure 7:
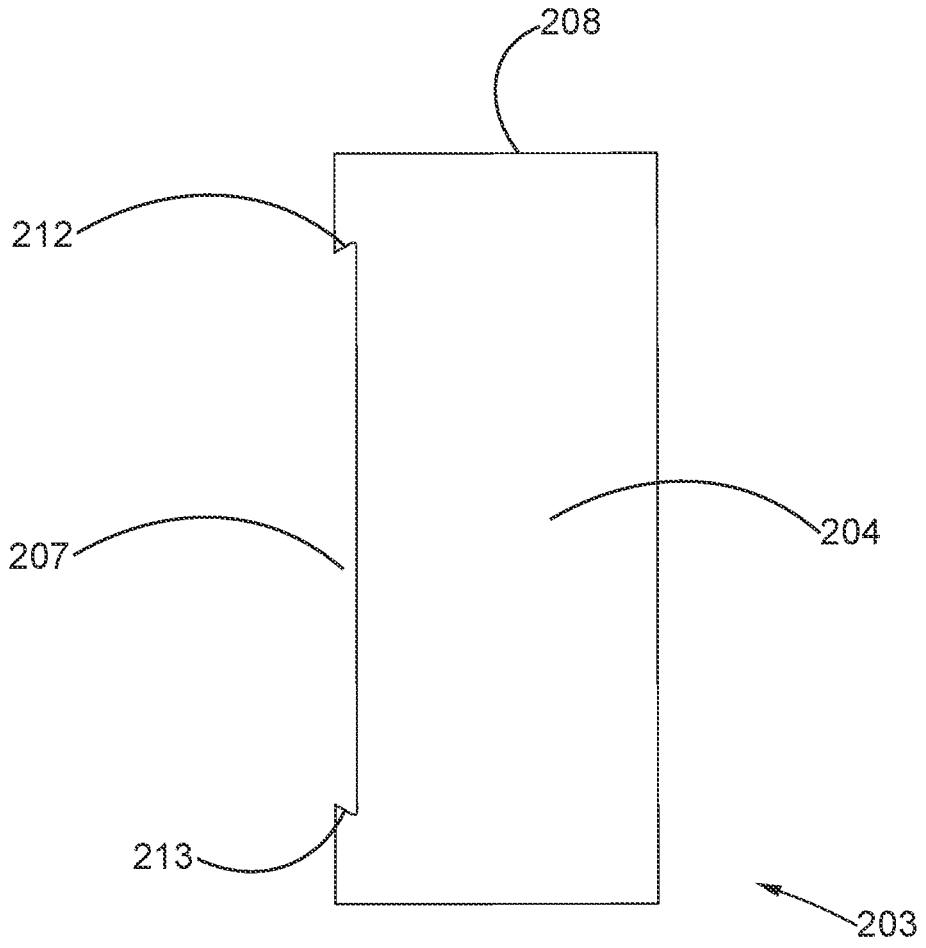
FIG. 7 is a side view of a cabinet used in the cabinet hanging system in accordance with the present invention, showing the right side of the cabinet.

Turning now to the next figure, FIG. 7 depicts a side view of the right side of a cabinet used in cabinet hanging system 200 in accordance with the present invention. First elongated recess 207 may be further comprised of first recess upper surface 212 and first recess lower surface 213. Though not shown, second elongated recess 210 may be designed similarly to first elongated recess 207.

Figure 8A:
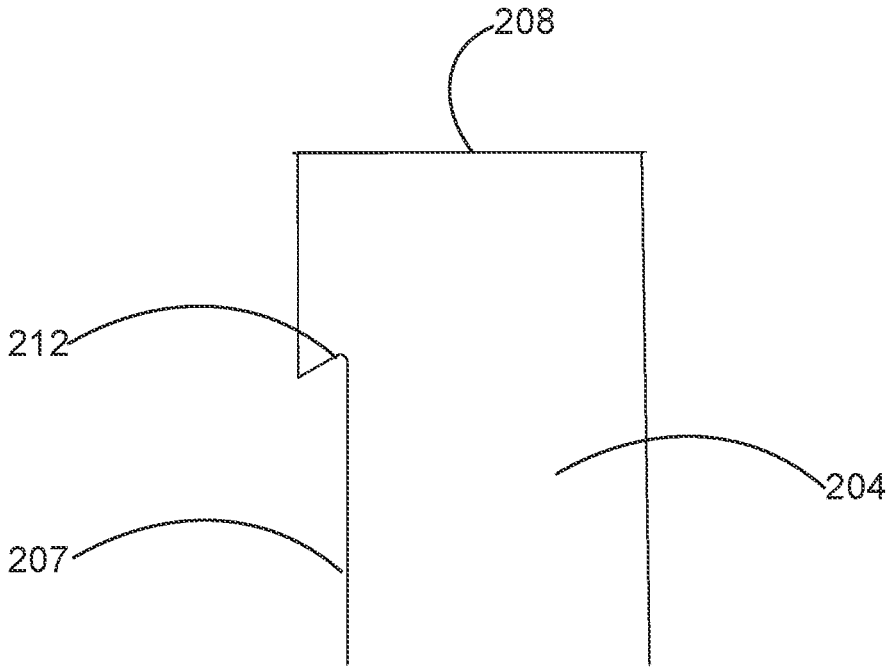
FIG. 8(*a*) is an enhanced view of the right side of the cabinet used in the cabinet hanging system in accordance with the present invention, showing more detail of a first elongated recess.
Figure 8B:
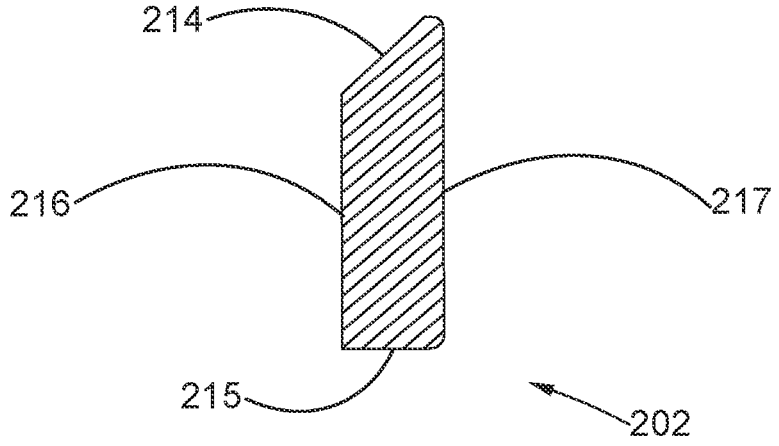

In some embodiments, first recess upper surface 212 may be angled diagonally up and toward the cavity defined by cabinet 203, and first recess lower surface 213 may be angled diagonally down and toward the cavity defined by cabinet 203. Thus, first elongated recess 207 may be convex, and the opening defined by first elongated recess 207 may extend along an inward side of right panel 204. The angled surfaces of first elongated recess 207 may be angled in order to allow first elongated recess 207 to easily catch and rest on wall cleat hanger 202. As shown in FIG. 8(*b*), the shape of wall cleat hanger 202 may substantially match the shape of first elongated recess 207. First elongated recess 207 may be any shape sufficient to retain wall cleat hanger 202 without departing from the scope and spirit of the present invention.

As can be seen from FIG. 7, first recess lower surface 213 may mirror first recess upper surface 212 along a horizontal axis. First recess lower surface 213 may be a mirrored reflection of first recess upper surface 212 because, as described above, a user may desire to rotate cabinet 203 180 degrees along its X-axis so that door 206 (not shown) opens in the opposite direction. To facilitate such rotations, first recess lower surface 213 may be angled diagonally down and toward the cavity defined by cabinet 203. Thus, when a user rotates cabinet 203 180 degrees along its X-axis, naturally leading to first recess lower surface 213 being superior to first recess upper surface 212, the user can still attach cabinet 203 to wall 201 using wall cleat hanger 202.

Though not shown, second elongated recess 210 may be substantially identical to first elongated recess 207, i.e., the upper surface of second elongated recess 210 may be angled diagonally up and toward the cavity defined by cabinet 203, and the lower surface of second elongated recess 210 may be angled diagonally down and toward the cavity defined by cabinet 203. Thus, second elongated recess 210 may be convex, and the opening defined by second elongated recess 210 may extend along an inward side of left panel 205. Second elongated recess 210 may be designed this way in order to more easily receive and retain wall cleat hanger 202.

FIG. 8(*a*) is an enhanced view of first elongated recess upper surface 212 in accordance with the present invention. First elongated recess upper surface 212 may be located substantially near upper panel 208. For example, and not limitation, first elongated recess upper surface 212 may be located four inches inferior to upper panel 208, and the angled portion of first elongated recess upper surface 212 may extend into right panel 204 seven-eighths of an inch. These measurements may be slightly larger than the measurements of wall cleat hanger 202 (See FIG. 8(*b*)), thus allowing wall cleat hanger 202 to snugly fit within first elongated recess 207. The measurements of first elongated recess upper surface 212 may be augmented or decreased without deviating from the scope or spirit of the present invention.

Though not shown, it is envisioned that first elongated recess lower surface 213 may be located substantially near lower panel 209. For example, and not limitation, first elongated recess lower surface may be located four inches superior to lower panel 209, and the angled portion of first elongated recess lower surface 213 may extend into right panel 204 seven-eighths of an inch. These measurements may be slightly larger than the measurements of wall cleat hanger 202 (See FIG. 8(*b*)), thus allowing wall cleat hanger 202 to snugly fit within first elongated recess 207. The measurements of first elongated recess lower surface 213 may be augmented or decreased without deviating from the scope or spirit of the present invention.

Additionally, the corresponding upper and lower surfaces of second elongated recess 210 may have measurements substantially similar to the measurements of first elongated recess 207.

Turning to the next figure, FIG. 8(*b*) illustrates a cross-sectional view of wall cleat hanger 202 in accordance with the present invention. Wall cleat hanger 202 may be comprised of wall cleat hanger upper surface 214, wall cleat hanger lower surface 215, wall cleat hanger wall surface 216, and wall cleat hanger cabinet surface 217. In preferred embodiments, wall cleat hanger upper surface 214 may abut and interact with first recess upper surface 212 of first recess 207 (and the upper surface of second recess 210), wall cleat hanger wall surface 216 may be adjacent to wall 201, and wall cleat hanger cabinet surface 217 may abut and interact with the rear exterior surfaces of right panel 204 and left panel 205.

The measurements of wall cleat hanger 202 may be similar to the measurements of first elongated recess 207 and second elongated recess 210. Having the measurements of wall cleat hanger 202 be similar to the measurements of first elongated recess 207 and second elongated recess 210 may allow cabinet 203 to lay flush against wall 201 and thus increase the stability and aesthetics of cabinet hanging system 200.

Figure 9A:
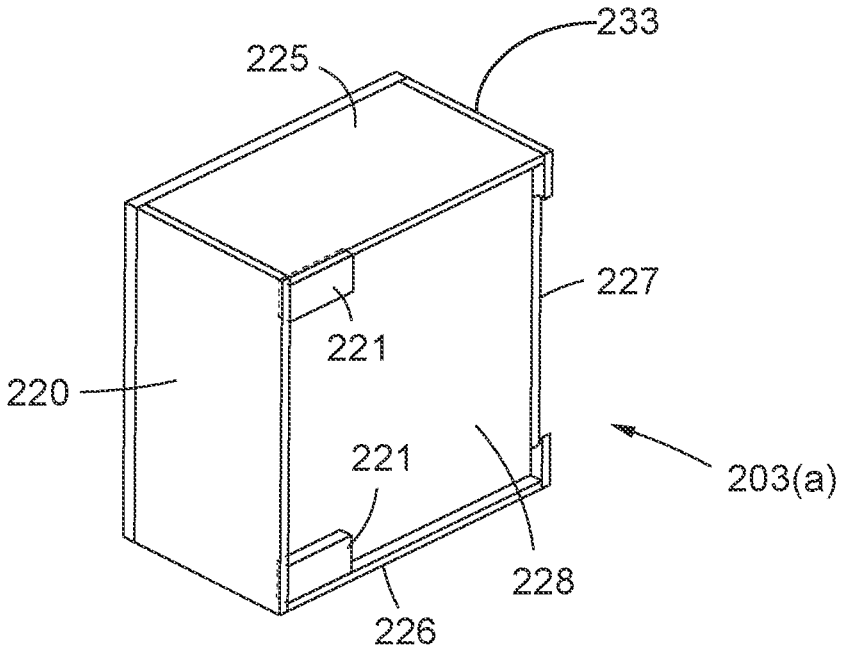
FIG. 9(*a*) is a rear perspective view of a terminal left cabinet in accordance with the present invention.
Figure 9B:
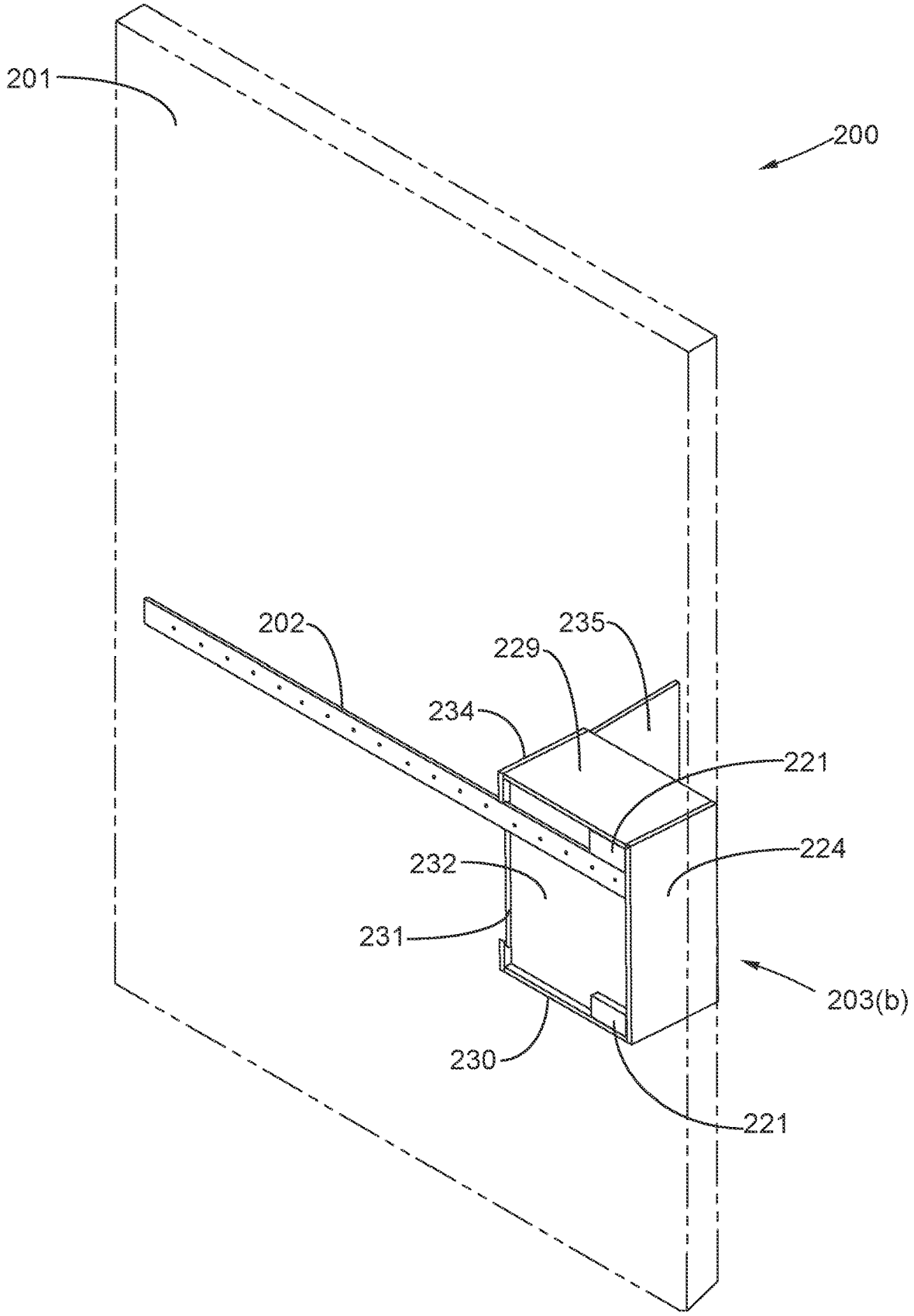
Figure 10:
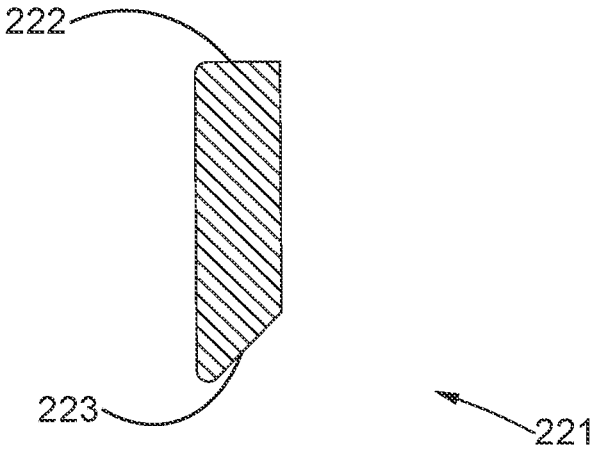
FIG. 10 is a cross-sectional view of a cabinet cleat in accordance with the present invention.

Turning to the next figures, FIG. 9(*a*) is a rear perspective view of a terminal left cabinet with a finished panel in accordance with the present invention, FIG. 9(*b*) is a rear perspective view of a terminal right cabinet with a finished panel attached to a wall cleat hanger, and FIG. 10 is a cross-sectional view of a cabinet cleat in accordance with the present invention.

It is envisioned in some embodiments of the present invention that wall cleat hanger 202 may be used to support more than one cabinet 203. In such embodiments, cabinet hanging system 200 may comprise terminal left cabinet 203 (*a*), terminal right cabinet 203 (*b*), and at least one cabinet 203 between terminal left cabinet 203 (*a*) and terminal right cabinet 203 (*b*). Other embodiments may comprise only a terminal left cabinet 203 (*a*) or terminal right cabinet 203 (*b*), such as in situations where the terminal cabinet is placed against a wall. In other embodiments, a user may install only terminal left cabinet 203 (*a*) and terminal right cabinet 203 (*b*) without cabinet 203 in between terminal left cabinet 203 (*a*) and terminal right cabinet 203 (*b*). As will be appreciated by a person of ordinary skill in the art, many configurations are possible without deviating from the scope of the present invention.

Terminal left cabinet 203 (*a*) may be comprised of finished left panel 220, cabinet cleat 221, upper panel 225, lower panel 226, elongated recess 227, rear panel 228, and right panel 233. Terminal left cabinet 203 (*b*) may be comprised of cabinet cleat 221, finished right panel 224, upper panel 229, lower panel 230, elongated recess 231, and rear panel 232.

As shown in FIG. 9(*a*), which depicts terminal left cabinet 203 (*a*), there may be only elongated recess 227 on right panel 233. Instead of an elongated recess on the left-hand side of terminal left cabinet 203 (*a*), there may be finished left panel 220. Finished left panel 220 may not be comprised of an elongated recess. By not including an elongated recess on finished left panel 220, wall cleat hanger 202 is hidden from view.

As seen in FIG. 9(*b*), which depicts terminal right cabinet 203 (*b*), there may be only elongated recess 231 on left panel 234. Instead of an elongated recess on the righthand side of terminal right cabinet 203 (*b*), there may be finished right panel 224. Finished right panel 224 may not be comprised of an elongated recess. By not including an elongated recess on finished right panel 224, wall cleat hanger is hidden from view.

As illustrated by FIG. 9(*b*), terminal right cabinet 203 (*b*) may rest on wall cleat hanger 202 via cabinet cleat 221. Cabinet cleat 221 may be comprised of cabinet cleat upper surface 222 and cabinet cleat lower surface 223 (See FIG. 10). Cabinet cleat upper surface may extend perpendicularly from wall 201 and terminal right cabinet 203 (*b*). Cabinet cleat lower surface 223 may extend diagonally downward from terminal right cabinet 203 (*b*) and wall 201. Specifically, cabinet cleat lower surface 223 may be angled in such a way in order to rest on wall cleat hanger 202 (See FIG. 8(*b*)). Though not shown, cabinet cleat 221 of terminal left cabinet 203 (*a*) may interact with and rest on wall cleat hanger 202 similar to how terminal right cabinet 203 (*b*) interacts with and rests on wall cleat hanger 202.

Cabinet cleat 221 may be located on rear panel 232 of terminal right cabinet 203 (*b*). Specifically, cabinet cleat 221 may be located on the terminal side of rear panel 232 of terminal right cabinet 203 (*b*) and positioned where upper panel 229 abuts finished right panel 224. Some embodiments of the present invention may include more than one cabinet cleat 221 on rear panel 232 of terminal right cabinet 203 (*b*). In such embodiments, cabinet cleat 221 may be positioned on rear panel 232 where upper panel 229 abuts finished right panel 224 and where lower panel 230 abuts finished right panel 224. Having more than one cabinet cleat 221 may allow a user to rotate terminal right cabinet 203 (*b*) horizontally around its center point and have door 235 open in a different orientation.

Referring back to FIG. 9(*a*), cabinet cleat 221 may be located on rear panel 228 of terminal left cabinet 203 (*a*). Specifically, cabinet cleat 221 may be located on the terminal side of rear panel 228 of terminal left cabinet 203 (*a*) and positioned where upper panel 225 abuts finished left panel 220. Some embodiments of the present invention may include more than one cabinet cleat 221 on rear panel 228 of terminal left cabinet 203 (*a*). In such embodiments, cabinet cleat 221 may be positioned on rear panel 228 where upper panel 225 abuts finished left panel 220 and where lower panel 226 abuts finished left panel 220. Having more than one cabinet cleat 221 may allow a user to rotate terminal left cabinet 203 (*a*) horizontally around its center point and have door 235 (not shown) open in a different orientation.

Terminal left cabinet 203 (*a*) and terminal right cabinet 203 (*b*) may be installed in a manner similar to how cabinet 203 is installed. For instance, and without limitation, a user may hold terminal left cabinet 203 (*a*) and terminal right cabinet 203 (*b*) above wall cleat hanger 202 and slide terminal left cabinet 203 (*a*) and terminal right cabinet 203 (*b*) down wall 201 until elongated recess 227, elongated recess 231, respectively, and cabinet cleat 221 catch and are able to rest on wall cleat hanger 202. Terminal left cabinet 203 (*a*) and terminal right cabinet 203 (*b*) may also be installed by aligning elongated recess 227 and elongated recess 231, respectively, with wall cleat hanger 202 and sliding terminal left cabinet 203 (*a*) and terminal right cabinet 203 (*b*) along wall cleat hanger 202 until a desired position is reached.

Figure 11:
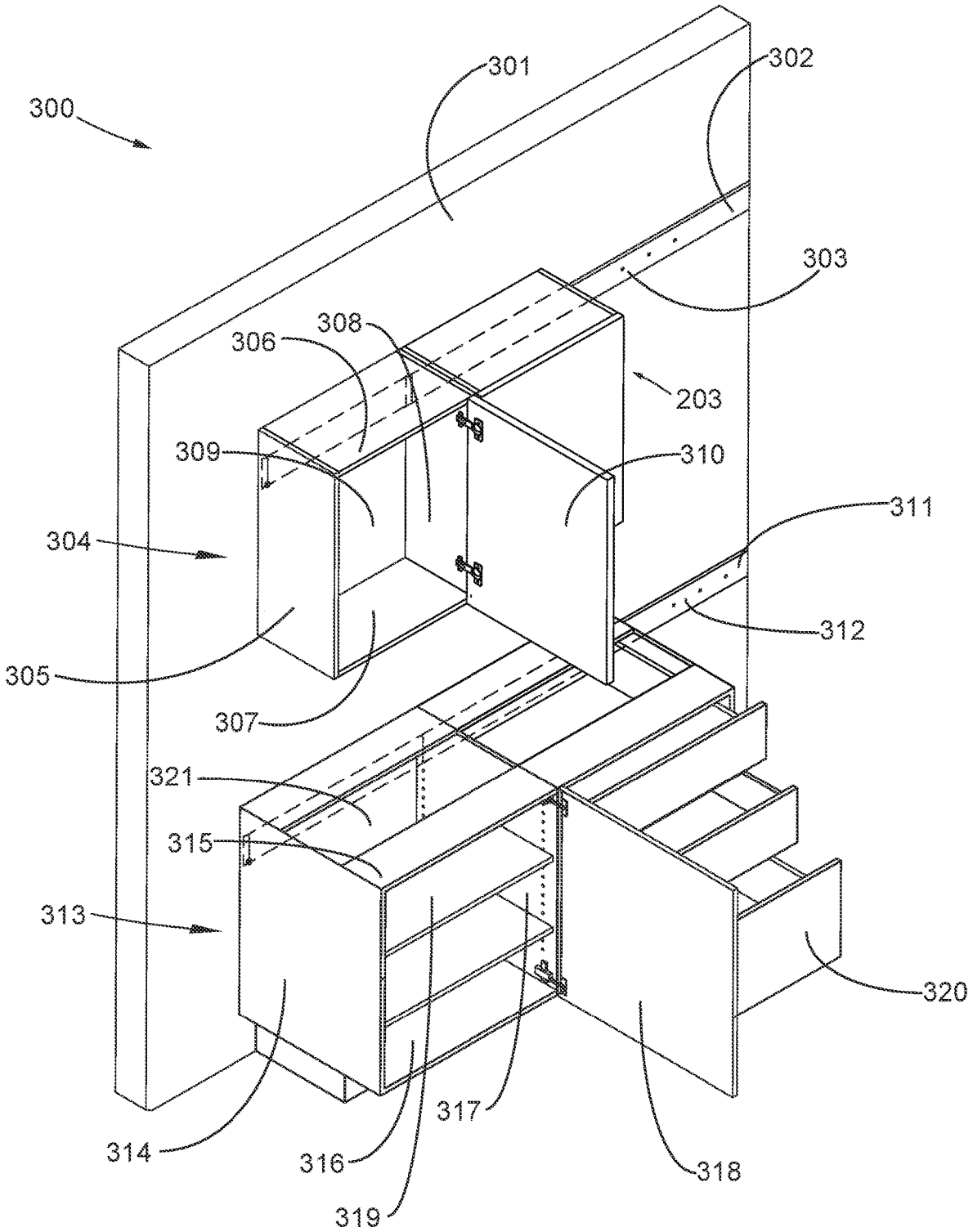
FIG. 11 is a perspective view of one embodiment of a cabinet hanging system in accordance with the present invention.

Turning to the next figure, FIG. 11 depicts a perspective view of one embodiment of a cabinet hanging system in accordance with the present invention. Specifically, FIG. 11 illustrates cabinet hanging system 300, which includes upper wall cleat hanger 302, upper terminal right cabinet 304, lower wall cleat hanger 311, and lower terminal right cabinet 313. Upper wall cleat hanger 302 may be comprised of plurality of holes 303 and lower wall cleat hanger 311 may be comprised of a plurality of holes 312, both of which may be used for receiving fasteners. Upper terminal right cabinet 304 may include finished right panel 305, upper panel 306, lower panel 307, left panel 308, rear panel 309, and door 310. Lower terminal right cabinet 313 may include finished right panel 314, upper panel 315, lower panel 316, left panel 317, rear panel 321, and door 318. It is envisioned that at least one cabinet 203 may be installed on upper wall cleat hanger 302 and/or lower wall cleat hanger 311.

Upper wall cleat hanger 302 and lower wall cleat hanger 311 may be attached to wall 301. It is envisioned that wall 301 is in a kitchen, but any wall suitable for cabinets is contemplated by the present invention, such as the walls in a garage or office. Upper wall cleat hanger 302 and lower wall cleat hanger 311 may be affixed to wall 301 using any fastening method known in the art. By way of example and not limitation, upper wall cleat hanger 302 may be affixed to wall 301 by hammering nails through plurality of holes 303. Similarly, lower wall cleat hanger 311 may be affixed to wall 301 by hammering nails through plurality of holes 312. Alternatively, other fasteners, such as screws, bolts, and/or adhesives, may be used without deviating from the scope or spirit of the present invention. A level (not shown) may be implemented to ensure upper wall cleat hanger 302 and lower wall cleat hanger 311 are level; this may help maintain upper terminal right cabinet 304 and lower terminal right cabinet 313 in place.

In one embodiment, plurality of holes 303 may be spaced along upper wall cleat hanger 302 such that each individual hole corresponds to a stud located within wall 301. The spacing of plurality of holes 312 may be similarly spaced along lower wall cleat hanger 311.

In some embodiments of the present invention, upper wall cleat hanger 302 and lower wall cleat hanger 311 may each be extendable in order to reach across at least a portion of wall 301. For example, and not limitation, upper wall cleat hanger 302 and lower wall cleat hanger 311 may each be a quarter-inch shorter than the sum of the width of upper panel 306 and/or upper panel 315. It is also contemplated by the present invention that upper wall cleat hanger 302 and lower wall cleat hanger 311 may each be a predetermined length based on the user's or a manufacturer's specifications.

The material from which upper wall cleat hanger 302 may be constructed is not to be limited. For example, and without limitation, upper wall cleat hanger 302 may be comprised of any metal, such as aluminum, suitable for supporting upper terminal right cabinet 304 and/or at least one cabinet 203. Alternative materials, such as wood and/or plastic, are also comprehended by the present invention and may be used to construct upper wall cleat hanger 302 and lower wall cleat hanger 311. Lower wall cleat hanger 311 may be similarly constructed.

In some embodiments of the present invention, upper terminal right cabinet 304 and lower terminal right cabinet 313 may each have elongated recesses that may be used to attach upper terminal right cabinet 304 and lower terminal right cabinet 313 to upper wall cleat hanger 302 and lower wall cleat hanger 311, respectively. These elongated recesses may be similar to first elongated recess 207, as shown in FIG. 6. Other embodiments of the present invention may also incorporate separate upper and lower recesses similar to first upper recess 107 and first lower recess 108, as seen in FIG. 2.

After installing upper wall cleat hanger 302 to a desired height on wall 301, a user may attach upper terminal right cabinet 304 to upper wall cleat hanger 302 by positioning the elongated recess located on a rear exterior edge of the left panel 308 (See FIG. 6) in such a way that the elongated recess may align with a terminal end of upper wall cleat hanger 302. As explained herein in more detail, the elongated recess may be of such a width that it can receive, and be flush with, upper wall cleat hanger 302. Once the elongated recess is aligned with upper wall cleat hanger 302, the user can easily slide upper terminal right cabinet 304 along upper wall cleat hanger 302 until upper terminal right cabinet 304 reaches a desired position on wall 301. As is apparent, no fasteners are required to attach upper terminal right cabinet 304 to upper wall cleat hanger 302.

In some embodiments, a user may attach upper terminal right cabinet 304 to upper wall cleat hanger 302 by positioning an upper surface of the elongated recess (See FIGS. 6 and 7) superior to upper wall cleat hanger 302 and lowering upper terminal right cabinet 304 until the upper surface of the elongated recess catches upper wall cleat hanger 302. This installation method is possible because the elongated recess does not have a lower boundary.

The installation method of lower terminal right cabinet 313 onto lower wall cleat hanger 311 may be similar to the methods used to install upper terminal right cabinet 304 onto upper wall cleat hanger 302.

Upper panel 306, lower panel 307, left panel 308, rear panel 309, and finished right panel 305 of upper terminal right cabinet 304 may be formed in such a shape to define a cavity therein. It is envisioned that upper terminal right cabinet 304 may be rectangularly shaped, though other shapes, including but not limited to square, circle, and oval, may be implemented and are contemplated by the present invention. Said cavity may be used to store any number of items. Upper panel 315, lower panel 316, left panel 317, rear panel 321, and finished right panel 314 of lower terminal right cabinet 313 may be formed similar to upper terminal right cabinet 304.

In some embodiments, upper terminal right cabinet 304 may be comprised of door 310, and lower terminal right cabinet 313 may be comprised door 318. Door 310 and door 318 may be useful in preventing the contents of upper terminal right cabinet 304 and lower terminal right cabinet 313 from falling out of the defined cavity. In one embodiment of the present invention, door 310 and door 318 may be fastened to an interior surface of left panel 308 and left panel 317, respectively, using any fastener suitable for fastening doors to cabinets, such as but not limited to, hinges and/or magnetic catches. Door 310 and door 318 may be fastened to the interior surface of any of the panels of upper terminal right cabinet 304 and lower terminal right cabinet 313, respectively. In other embodiments of the present invention, the cabinets may be framed cabinets. In such embodiments, door 310 and door 318 may attach to the cabinet frame.

There may be situations that call for door 310, after it is attached to upper terminal right cabinet 304, to be oriented differently to allow door 310 to open in a different direction. Rather than having to detach and reattach door 310, which can be tedious, difficult, and time consuming, a user need merely slide and/or lift upper terminal right cabinet 304 off upper wall cleat hanger 302, rotate upper terminal right cabinet 304 180 degrees along its X-axis, and slide and/or lower upper terminal right cabinet 304 onto upper wall cleat hanger 302. Doing so effectively flips upper terminal right cabinet 304 such that door 310 may now open in an orientation opposite from the orientation door 310 opened before the 180-degree rotation (i.e., door 310 opens towards the user's left-hand side instead of their right-hand side, or vice versa depending on door 310's pre-rotation orientation). Door 318 may be similarly rotated. In some embodiments, the orientation of lower terminal right cabinet 313 may be fixed such that lower terminal cabinet 313 cannot be flipped; for example, because some cabinets such as base cabinets are built so that a base panel does not match a top panel.

In some embodiments of the present invention, upper terminal right cabinet 304 and lower terminal right cabinet 313 may be empty. In other embodiments, upper terminal right cabinet 304 and lower terminal right cabinet 313 may each be comprised of at least one shelf 319. It is envisioned that more than one shelf 319 may be implemented. Shelf 319 may be installed via methods known in the art, such as, for example, by having pegs located on the interior of the side panels that extend into the interior of upper terminal right cabinet 304 and/or lower terminal right cabinet 313. Shelf 319 may rest on and be supported by the pegs. The pegs may attach to the side panels of upper terminal right cabinet 304 and/or lower terminal right cabinet 313 via a series of peg-receiving holes extending from the upper and lower panels (306, 307, 315, and 316) of upper terminal right cabinet 304 and/or lower terminal right cabinet 313, respectively. Having a series of peg-receiving holes allows the user to adjust the height of where shelf 319 is placed. In still other embodiments, upper terminal right cabinet 304 and/or lower terminal right cabinet 313 may be comprised of drawer 320. Drawer 320 may be located on a track attached to the side panels of upper terminal right cabinet 304 and/or lower terminal right cabinet 313, thus allowing the user to pull out and push in the drawer 320. Other drawer systems known in the art are also contemplated by the present invention.

Upper panels 306 and 315, lower panels 307 and 316, left panels 308 and 317, finished right panels 305 and 314, rear panels 309 and 321, and doors 310 and 318, may be constructed out of any material suitable for cabinets. By way of example and not limitation, wood, metal, and/or plastic may be used. This list of materials is non-exhaustive as other materials known in the art are contemplated by the present invention.

Upper wall cleat hanger 302 and lower wall cleat hanger 311 may be similar to wall cleat hanger 202, as seen in FIG. 8(*b*). Upper wall cleat hanger 302 and lower wall cleat hanger 311 may each be comprised of a wall cleat hanger upper surface, a wall cleat hanger lower surface, a wall cleat hanger wall surface, and a wall cleat hanger cabinet surface. In preferred embodiments, the wall cleat hanger upper surface may abut and interact with the upper surfaces of the elongated recesses of upper terminal right cabinet 304 and lower terminal right cabinet 313, respectively, the wall cleat hanger wall surface may be adjacent to wall 301, and the wall cleat hanger cabinet surface may abut and interact with the rear exterior surfaces of the finished right panels 305 and 314, respectively, and left panels 308 and 317, respectively, of upper terminal right cabinet 304 and lower terminal right cabinet 313.

The measurements of upper wall cleat hanger 302 and lower wall cleat hanger 311 may be similar to the measurements of the elongated recesses of upper terminal right cabinet 304 and lower terminal right cabinet 313. Having the measurements of upper wall cleat hanger 302 and lower wall cleat hanger 311 be similar to the measurements of the elongated recesses may allow upper terminal right cabinet 304 and lower terminal right cabinet 313 to lay flush against wall 301, thus increasing the stability and aesthetics of the cabinet hanging system 300.

Upper terminal right cabinet 304 and lower terminal right cabinet 313 may each only be comprised of a single elongated recess. Instead of an elongated recess on the righthand side of upper terminal right cabinet 304 and the righthand side of terminal right lower terminal right cabinet 313, there may be finished right panel 305 and finished right panel 314, respectively. Finished right panel 305 and finished right panel 314 may not be comprised of an elongated recess. By not including an elongated recess on finished right panel 305 and finished right panel 314, upper wall cleat hanger 302 and lower wall cleat hanger 313, respectively, are hidden from view. Though not shown, the leftmost upper terminal cabinet and the leftmost lower terminal cabinet may each have an elongated recess on a right panel and a finished terminal panel on a left panel.

Upper terminal right cabinet 304 and lower terminal right cabinet 313 may rest on upper wall cleat hanger 302 and terminal lower terminal right cabinet 313, respectively, via a cabinet cleat similar to cabinet cleat 221 (See FIGS. 9(*b*) and 10). The cabinet cleat may be comprised of a cabinet cleat upper surface and a cabinet cleat lower surface. The cabinet cleat upper surface may extend perpendicularly from wall 301 and upper terminal right cabinet 304 and lower terminal right cabinet 313. The cabinet cleat lower surface may extend diagonally downward from wall 301 and upper terminal right cabinet 304 and lower terminal right cabinet 313. The cabinet cleat lower surface may be angled in such a way to rest on upper wall cleat hanger 302 and lower wall cleat hanger 311, respectively.

The cabinet cleat may be located on rear panel 309 of upper terminal right cabinet 304 similar to cabinet cleat 221

(See FIG. 9(*a*)). Specifically, the cabinet cleat may be located on the exterior side of rear panel 309 of upper terminal right cabinet 304 and positioned where upper panel 306 abuts finished right panel 305. Some embodiments of the present invention may include more than one cabinet cleat on rear panel 309 of upper terminal right cabinet 304. In such embodiments, the cabinet cleat may be positioned on an exterior side of rear panel 309 where upper panel 306 abuts finished right panel 305 and where lower panel 307 abuts finished right panel 305. Having multiple cabinet cleats may allow a user to rotate upper terminal right cabinet 304 horizontally around its center point and have door 310 open in a different orientation. The cabinet cleat may be similarly located on lower terminal right cabinet 313.

Though not shown, it is envisioned by the present invention that cabinet hanging system 300 may also comprise an upper terminal left cabinet and a lower terminal left cabinet, which may be similar to upper terminal right cabinet and lower terminal right cabinet, respectively.

A cabinet hanging system has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

What is claimed is:

1. A cabinet hanging system for mounting cabinets to a wall, comprising:

a wall cleat hanger; and an at least one cabinet comprising a right panel opposite a left panel, an upper panel, a lower panel, and a rear panel which define a cavity:

a rear exterior edge on the right panel that comprises a first elongated recess that vertically extends from substantially near the upper panel to substantially near the lower panel; and a rear exterior edge on the left panel that comprises a second elongated recess that vertically extends from substantially near the upper panel to substantially near the lower panel, wherein the rear exterior edge on the right panel and the rear exterior edge on the left panel extend beyond a posterior surface of the rear panel to preclude the posterior surface of the rear panel from making contact with a wall adapted with the wall cleat hanger; and wherein the first elongated recess and second elongated recess each comprise an upper surface that is angled diagonally up and toward the cavity and a lower surface that is angled diagonally down and toward the cavity, the first elongated recess and the second elongated recess adapted to be installed on the wall cleat hanger on a first position along an x-axis of the at least one cabinet and to be installed on the wall cleat hanger on a second position by rotating the at least one cabinet 180 (degrees) along the x-axis of the at least one cabinet.

2. The cabinet hanging system of claim 1, further comprising a terminal left cabinet including:

a rear exterior edge of a right panel of the terminal left cabinet comprising a first elongated recess that vertically extends from substantially near an upper panel of the terminal left cabinet to substantially near a lower panel of the terminal left cabinet; and a rear exterior surface of a left panel of the terminal left cabinet comprising a finished left panel.

3. The cabinet hanging system of claim 1, further comprising a terminal right cabinet including:

a rear exterior edge of a left panel of the terminal right cabinet comprising a first elongated recess that vertically extends from substantially near an upper panel of the terminal right cabinet to substantially near a lower panel of the terminal right cabinet; and a rear exterior surface of a right panel of the terminal right cabinet comprising a finished right panel.

4. The cabinet hanging system of claim 2, wherein the terminal left cabinet further includes a first cabinet cleat located on an exterior surface of a rear panel of the terminal left cabinet where the upper panel intersects the finished left panel.

5. The cabinet hanging system of claim 2, wherein the terminal left cabinet further includes a second cabinet cleat located on the exterior surface of a rear panel of the terminal left cabinet where the lower panel intersects the finished left panel.

6. The cabinet hanging system of claim 3, wherein the terminal right cabinet further includes a first cabinet cleat located on an exterior surface of a rear panel of the terminal cabinet where the upper panel intersects the finished right panel.

7. The cabinet hanging system of claim 3, wherein the terminal right cabinet further includes a second cabinet cleat located on an exterior surface of a rear panel of the terminal right cabinet where the lower panel intersects the finished right panel.

8. The cabinet hanging system of claim 1, wherein the cabinet comprises at least one cabinet door, wherein the at least one cabinet door is attached to an interior surface of a cabinet panel and wherein the at least one cabinet door opens outward.

9. A cabinet, comprising:

a right panel, a left panel, an upper panel at a first terminal end of the cabinet, a lower panel at second terminal end of the cabinet, and a rear panel which define a cavity, wherein:

a rear exterior edge of the right panel comprises a first elongated recess that vertically extends from substantially near the upper panel to substantially near the lower panel; and a rear exterior edge of the left panel comprises a second elongated recess that vertically extends from substantially near the upper panel to substantially near the lower panel; and wherein the first and second elongated recess are adapted to register with a wall cleat hanger affixed to a wall; and wherein the rear exterior edge on the right panel and the rear exterior edge on the left panel extend beyond a posterior surface of the rear panel to preclude the posterior surface of the rear panel from making contact with the wall adapted with the wall cleat hanger; and wherein the first elongated recess and second elongated recess each comprise an upper surface that is angled diagonally up and toward the cavity and a lower surface that is angled diagonally down and toward the cavity, the first elongated recess and the second elongated recess adapted to be installed on the wall cleat hanger on a first position along an x-axis of the cabinet and to be installed on the wall cleat hanger on a second position by rotating the cabinet 180 (degrees) along the x-axis of the cabinet.

10. The cabinet of claim 9, wherein the cabinet comprises at least one cabinet door, wherein the at least one cabinet door is attached to an interior surface of a cabinet panel and wherein the at least one cabinet door opens outward.

11. The cabinet of claim 10, wherein the rear panel of the cabinet is offset into the cabinet by a distance sufficient to allow the first elongated recess and the second elongated recess to receive and rest on the wall cleat hanger.

12. The cabinet of claim 9, wherein the rear panel of the cabinet is offset into the cabinet by a distance sufficient to allow the first elongated recess and the second elongated recess to receive and rest on the wall cleat hanger.

* * * * *